US005236819A

United States Patent [19]

Kadokura et al.

[11] Patent Number: 5,236,819

[45] Date of Patent: Aug. 17, 1993

[54] LIGHT-SENSITIVE SILVER HALIDE PHOTOGRAPHIC MATERIAL CAPABLE OF PRODUCING A DYE IMAGE WITH IMPROVED FASTNESS

[75] Inventors: Kenji Kadokura; Katsumasa Yamazaki; Shigeto Hirabayashi, all of Hino, Japan

[73] Assignee: Konica Corporation, Japan

[21] Appl. No.: 699,680

[22] Filed: May 14, 1991

[30] Foreign Application Priority Data

May 17, 1990 [JP] Japan ..... 2-127239

[51] Int. Cl.[5] ..... G03C 7/38; G03C 7/392

[52] U.S. Cl. ..... 430/551; 430/546; 430/558

[58] Field of Search ..... 430/558, 551, 607, 614, 430/546

[56] References Cited

U.S. PATENT DOCUMENTS 4,906,559 3/1990 Nishijima et al. ..... 430/558
5,017,465 5/1991 Nishijima ..... 430/558
5,063,148 11/1991 Sugita et al. ..... 430/558

FOREIGN PATENT DOCUMENTS 273412 7/1988 European Pat. Off. .
3605279 8/1986 Fed. Rep. of Germany .

OTHER PUBLICATIONS

Patent Abstracts of Japan, vol. 13, No. 175 (p-863) (3523); Apr. 25, 1989 JPA-1-9458; Jan. 12, 1989.

*Primary Examiner*—Lee C. Wright
*Attorney, Agent, or Firm*—Jordan B. Bierman

[57] ABSTRACT

A photographic material having a support and a light sensitive silver halide emulsion layer which contains a magenta coupler represented by Formula M-I, a compound represented by Formula A and a compound represented by Formula B:

Formula M-I

Formula A

Formula B wherein the substituents are as defined in the specification.

7 Claims, No Drawings

LIGHT-SENSITIVE SILVER HALIDE PHOTOGRAPHIC MATERIAL CAPABLE OF PRODUCING A DYE IMAGE WITH IMPROVED FASTNESS

BACKGROUND OF THE INVENTION

The present invention relates to a silver halide photographic light-sensitive material capable of forming a dye image improved in fastness to heat or light and free from stains.

A dye image formed by a silver halide photographic light-sensitive material is required not to discolor nor fade during long-time storage at high temperature and humidity. Also, the non-color-forming portion of a light-sensitive material is required not to get yellow stains (hereinafter referred to as "Y-stains") when exposed to light, heat or moisture.

For forming magenta dyes, couplers consisting mainly of pyrazolone, pyrazolobenzimidazole, pyrazolotriazole or indazolone are commonly employed.

As compared with yellow and cyan dyes, magenta dyes are more subject to fading by exposure to light. In addition, the problem of Y-stain formation is more serious in magenta couplers than in yellow and cyan couplers.

Meanwhile, 1,2-pyrazolo-5-ones are widely employed as the magenta coupler. They are not satisfactory in color reproducibility, since a magenta dye formed therefrom has unnecessary secondary absorption at about 430 nm, besides primary one at about 550 nm. Various studies have heretofore been made to minimize such secondary absorption.

For instance, U.S. Pat. No. 2,343,703 and British Patent No. 1,059,994 each describe a magenta coupler consisting of 1,2-pyrazolo-5-one having an anilino group at the 3-position. This coupler is suitable for use in preparing photoprints for direct visual appreciation, since a dye formed therefrom has minimized secondary absorption. However, it is considerably defective in image preservability; a magenta dye formed therefrom readily fades by exposure to light, and a large part of the unreacted portion of the coupler tends to become Y-stains.

The following compounds were also proposed as the magenta coupler capable of forming a magenta dye having minimized secondary absorption at about 430 nm; pyrazolobenzimidazoles (British Patent No. 1,047,612), indazolones (U.S. Pat. No. 3,770,447), 1H-pyrazolo [51-c]-1,2,4-triazole (U.S. Pat. No. 3,725,067, British Patent Nos. 1,252,418 and 1,334,515), 1H-pyrazolo [1,5-b]-1,2,4-triazole (Japanese Patent Publication Open to Public Inspection, hereinafter abbreviated as "Japanese Patent O.P.I. Publication", No. 171956/1984, Research Disclosure No. 24,531), 1H-pyrazolo [1,5-c]-1,2,3-triazole (Research Disclosure No. 24,626), 1H-imidazo [1,2-b] pyrazole (Japanese Patent O.P.I. Publication No. 162548/1984 and Research Disclosure No. 24,531), 1H-pyrazolo [1,5-b]pyrazole (Japanese Patent O.P.I. Publication No.43659/1985 and Research Disclosure No. 24,230), and 1H-pyrazolo [1,5-d] tetrazole (Japanese Patent O.P.I. Publication No. 33552/1985 and Research Disclosure No. 24,220). Of the above couplers, especially preferred are 1H-pyrazolo [5,1-c]-1,2,4-triazole, 1H-pyrazolo [1,5-b]-1,2,4-triazole, 1H-pyrazolo [1,5-c]-1,2,3-triazole, 1H-imidazo [1,2-b]-pyrazole, 1H-pyrazolo [1,5-d] pyrazole and 1H-pyrazolo [1,5-d] tetrazole. They are capable of forming a dye having much smaller secondary absorption at about 430 nm than that formed from the 1,2-pyrazolo-5-one coupler having an anilino group at the 3-position, and eventually have more improved color reproducibility than the 1,2-pyrazolo-5-one coupler, and are almost free from the Y-stain formation problem.

However, an azomethine dye formed from these couplers has considerably poor light fastness, and readily discolors when exposed to light. Therefore, these couplers are unsuitable for use in light-sensitive materials for color photoprints, and none of them has been practically used for that purpose Japanese Patent O.P.I. Publication No. 125732/1984 discloses a method for improving the light fastness of a magenta dye image formed from 1H-pyrazolo [5,1-c]-1,2,4-triazole by using a phenol compound or a phenyl ether compound in combination with this coupler. This method, however, is still insufficient to prevent a magenta dye image from fading, and almost impossible to prevent it from discoloring in light.

SUMMARY OF THE INVENTION

One object of the invention is to provide a silver halide photographic light-sensitive material capable of forming a magenta dye having no secondary absorption and a magenta dye image remarkably improved in light fastness.

Another object of the invention is to provide a silver halide photographic light-sensitive material capable of forming a magenta dye image which hardly discolors when exposed to light.

Still another object of the invention is to provide a silver halide photographic light-sensitive material of which the non-color-forming portion hardly gets Y-stains when exposed to moisture or heat.

The silver halide photographic light-sensitive material of the invention contains a magenta coupler represented by Formula M-I, a compound represented by Formula A and a compound represented by Formula B:

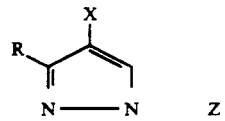

M-I wherein Z represents a group of non-metallic atoms necessary for forming a nitrogen-containing heterocyclic ring which may have a substituent; X represents a hydrogen atom or a group which can be released by a coupling reaction with the oxidized product of a color developing agent; and R represents a hydrogen atom or a substituent.

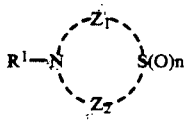

Formula A wherein $R_1$ represents an aryl group or a heterocyclic group; $Z_1$ and $Z_2$ each represent an alkylene group having 1 to 3 carbon atoms, provided that the total carbon number of the alkylene groups is 3 to 6; and n represents 1 or 2.

Formula B

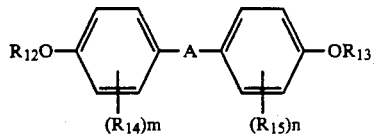

wherein $R_{12}$ and $R_{13}$ each represent a hydrogen atom, an alkyl group, a cycloalkyl group, an alkenyl group or an aryl group; $R_{14}$ and $R_{15}$ each represent a halogen atom, an alkyl group, a cycloalkyl group, an alkenyl group, an alkoxy group, an aryl group, an aryloxy group, an alkylthio group, an arylthio group, an acyl group, an acylamino group, a sulfonyl group, a sulfonamide group or a hydroxy group; m and n each represent an integer of 0 to 4, and when m is 2 to 4, $R_{14}$ may be either identical with or different from each other, and when n is an integer of 2 to 4, $R_{15}$ may be either identical with or different from each other; and A represents an alkylene group having 1 to 6 carbon atoms in its linear structure.

DETAILED DESCRIPTION OF THE INVENTION

The present invention will be described in detail.

In the magenta coupler represented by Formula M-I, Z represents a group of non-metallic atoms necessary for forming a nitrogen-containing heterocyclic ring which may have a substituent.

X represents a hydrogen atom or a group which can be released by a coupling reaction with the oxidized product of a color developing agent.

R represents a hydrogen atom or a substituent. The substituent represented by R is not limitative; the typical examples of which include alkyl, aryl, anilino, acylamino, sulfoneamide, alkylthio, arylthio, alkenyl, cycloalkyl, and further to these exemplified are halogen, cycloalkenyl, alkinyl, heterocycle, sulfonyl, sulfinyl, phosphonyl, acyl, carbamoyl, sulfamoyl, cyano, alkoxy, aryloxy, heterocyclic oxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl, heterocyclic thio, spiro compound residues and bridged hydrocarbon compound residues.

As the alkyl group, preferred is a straight or branched alkyl having 1 to 32 carbon atoms. Phenyl is preferable as the aryl group. The examples of the acylamino group include alkylcarbonylamino and arylcarbonylamino, and those of the sulfonamide group include alkylsulfonylamino and arylsulfonylamino. The alkyl component in the alkylthio group and the aryl component in the arylthio group are respectively the alkyl group and the aryl group represented by R. As the alkenyl group, preferred is a straight or branched alkenyl having 2 to 32 carbon atoms. The cycloalkyl group preferably has 3 to 12, more preferably 5 to 7 carbon atoms. Alkylsulfinyl and arylsulfinyl are preferable as the sulfinyl group. Alkylphosphonyl, alkoxyphosphonyl, aryloxyphosphonyl and arylphosphonyl are preferred as the phosphonyl group. Alkylcarbamoyl and arylcarbamoyl are preferred as the carbamoyl group. Alkylsulfamoyl and arylsulfamoyl are preferred as the sulfamoyl group. Alkylcarbonyloxy and arylcarbonyloxy are preferable as the acyloxy group. Alkylcarbamoyloxy and arylcarbamoyloxy are preferable as the carbamoyloxy group. Alkylureido and arylureido are preferable as the ureido group. Alkylsulfamoylamino and arylsulfamoylamino are preferable as the sulfamoylamino group. 5 to 7-membered rings are preferable as the heterocyclic ring, the specific examples of which including 2-furyl, 2-thienyl, 2-pyrimidinyl and 2-benzothiazolyl. As the heterocyclic oxy group, preferred are those having a 5 to 7-membered ring, the specific examples of which including 3,4,5,6-tetrahydropyranyl-2-oxy and 1-phenyltetrazole-5-oxy. 5 to 7-membered heterocyclic thio groups, such as 2-pyridylthio, 2-benzothiazolylthio, 2,4-diphenoxy-1,3,5-triazole-6-thio, are preferable as the heterocyclic thio group. Trimethylsiloxy, triethylsiloxy and dimethylbutylsiloxy are preferable as the siloxy group. Succinimide, 3-heptadecylsuccinimide, phthalimide and glutarimide are preferable as the imide group. Spiro [3.3] heptane-1-yl is preferable as the spiro compound residue. Bicyclo [2.2.1] heptane-1-yl, tricyclo [3.3.1.1 $^{3,7}$] decane-1-yl and 7,7-dimethyl-bicyclo [2.2.1] heptane-1-yl are preferable as the bridged hydrocarbon compound residue.

The examples of the group represented by X, which can be released by a coupling reaction with the oxidized product of a color developing agent, include halogen (e.g. chlorine, bromine, fluorine), alkoxy, aryloxy, heterocyclic oxy, acyloxy, sulfonyloxy, alkoxycarbonyloxy, aryloxycarbonyl, alkyloxalyloxy, alkoxyoxalyloxy, alkylthio, arylthio, heterocyclic thio, alkyloxythiocarbonylthio, acylamino, sulfoneamide, a nitrogen-containing heterocyclic ring, alkyloxycarbonylamino, aryloxycarbonylamino, carboxyl and

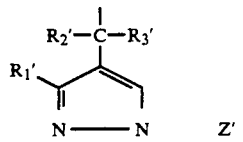

wherein $R_1'$ has the same meaning as R; Z' has the same meaning as Z; and $R_2'$ and $R_3'$ each represent a hydrogen atom, an aryl group or a heterocyclic group). Of them, a halogen atom, in particular, chlorine, is preferable.

The examples of the nitroten-containing heterocycle formed by Z or Z' include pyrazole rings, imidazole rings, triazole rings and tetrazole rings. The examples of the substituent which may be contained in this heterocycle are the groups and atoms mentioned as the examples of R.

The specific examples of the magenta coupler represented by Formula M-I are given below:

Formulae M-II to M-VIII

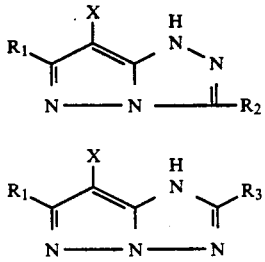

-continued

Formulae M-II to M-VIII

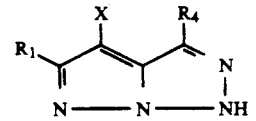

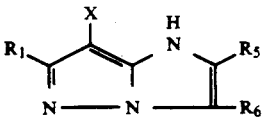

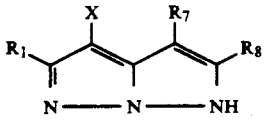

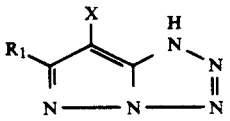

In the above formulae, $R_1$ to $R_6$ each have the same meaning as R in Formula M-I, and X has the same meaning as X in Formula M-I. Of the magenta couplers represented by Formula M-I, those represented by Formula VIII are especially preferable.

Formula M-VIII

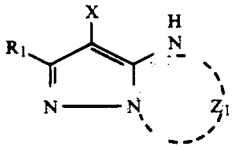

wherein $R_1$, X and $Z_1$ respectively have the same meaning as R, X and Z in Formula M-I.

Of the magenta couplers represented by Formulae M-II to M-VII, especially preferred are those represented by Formula M-II.

Of the substituents R and $R_1$ on the heterocyclic ring, most preferable are those represented by the following Formula M-IX:

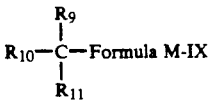

wherein $R_9$, $R_{10}$ and $R_{11}$ are each have the same meaning as R in Formula M-I. Two of $R_9$, $R_{10}$ and $R_{11}$ (e.g. $R_9$ and $R_{10}$) may be combined with each other to form a saturated or unsaturated ring (e.g. cycloalkane, cycloalkene, a heterocyclic ring). $R_{11}$ may be bounded to this ring to form a bridged hydrocarbon compound residue.

Of the substituents represented by Formula M-IX, preferable are: (i) those in which at least two of $R_9$ to $R_{11}$ are alkyl; and (ii) those in which one of $R_9$ to $R_{11}$ is hydrogen, and the remaining two are combined with each other to form cycloalkyl with a root carbon atom. Of the substituents defined by (i), further preferable are those in which two of $R_9$ to $R_{11}$ are alkyl and the remaining one is either hydrogen or alkyl.

Most preferable examples of R is a lower alkyl group having 1 to 4 carbon atoms. Typical examples are methyl and impropyl.

The substituents for the rings formed by Z in Formula M-I and $Z_1$ in Formula M-VIII, and the groups represented by $R_2$ to $R_8$ in Formula M-VI are represented preferably by the following Formula M-X:

Formula M-X $$-R^1-SO_2-R^2$$

wherein $R_1$ represents alkylene, alkylarylen or alkylamino and $R_2$ represents alkyl, cycloalkyl or aryl.

The alkylene is prefereble as the group represented by $R_1$ and is a linear or branched alkylene which preferably has 2 or more, more preferably 3 to 6 carbon atoms in its linear structure. The cycloalkyl group represented by $R_2$ is preferably 5 to 6-membered.

The representative examples of the compound of the invention are given below:

1

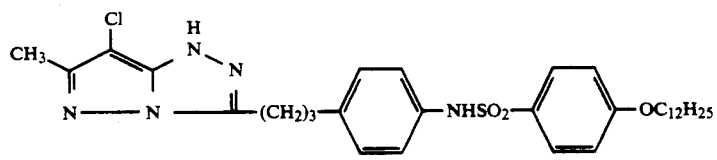

2

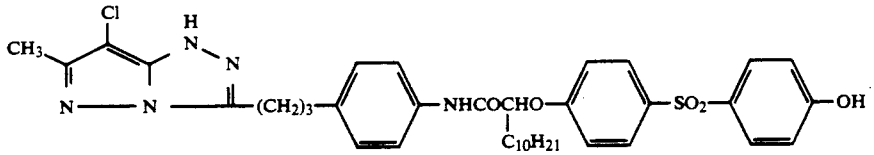

3

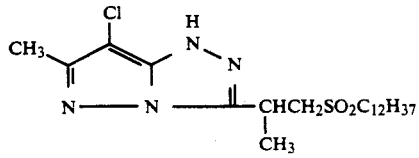

-continued
4
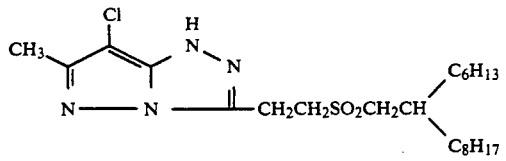
5
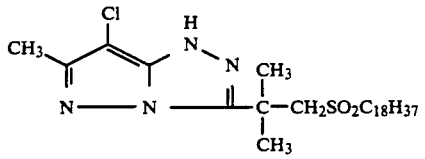
6
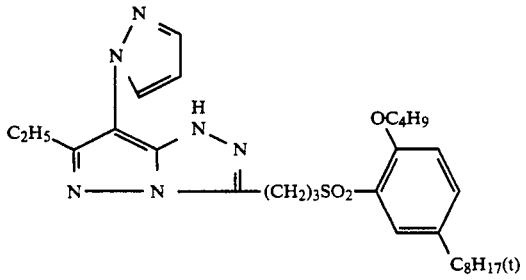
7
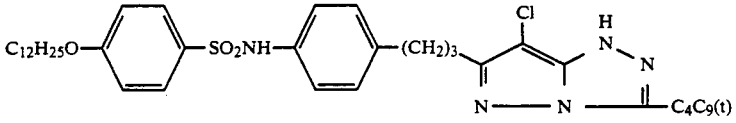
8
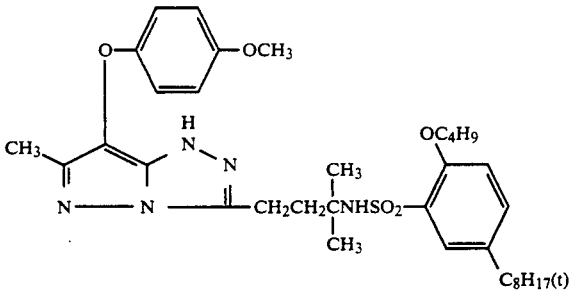
9
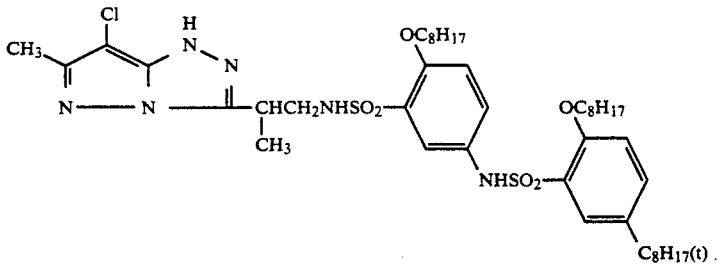
10
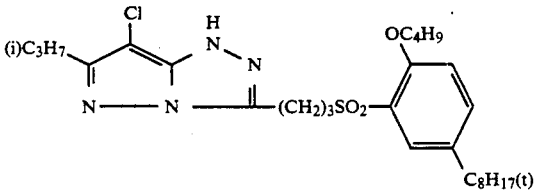

-continued
11
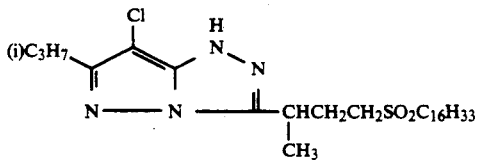
12
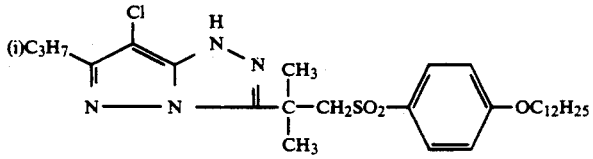
13
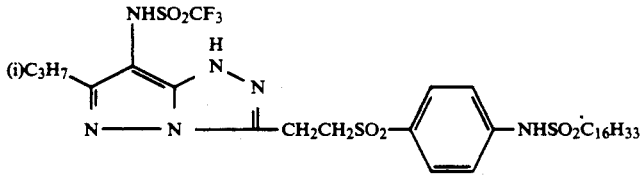
14
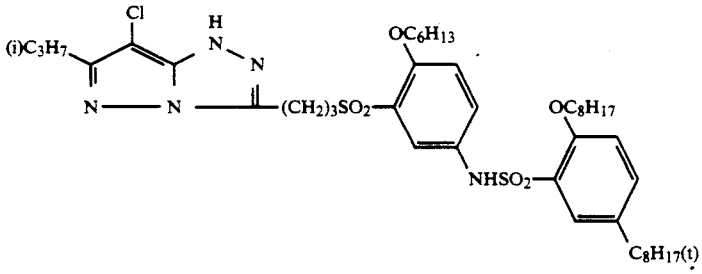
15
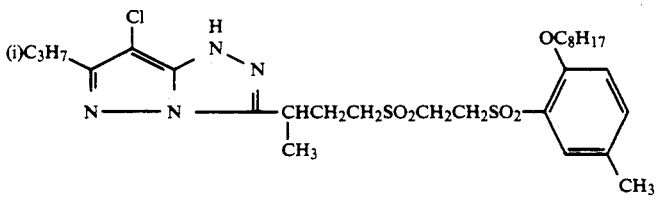
16
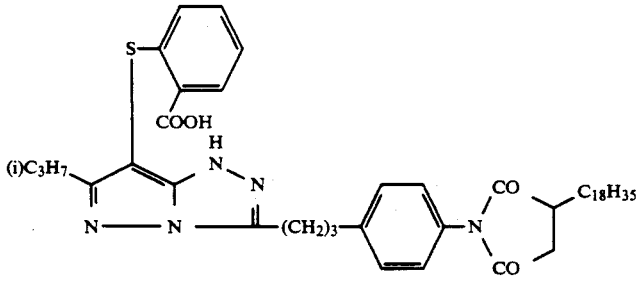
17
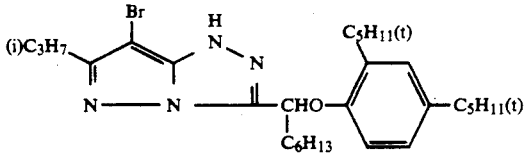
18
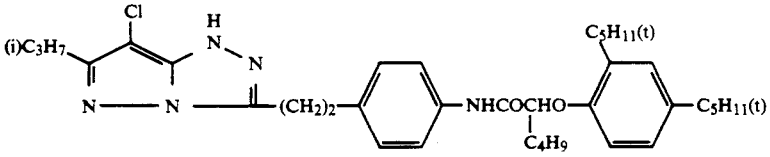

-continued
19
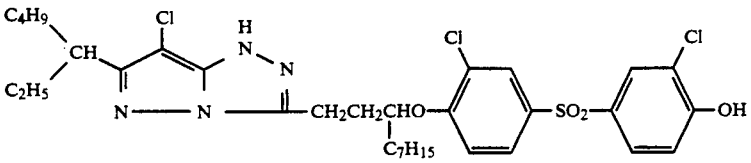
20
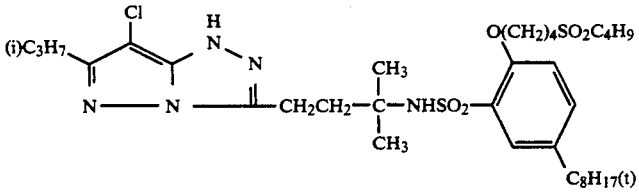
21
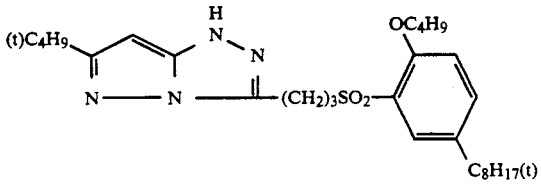
22
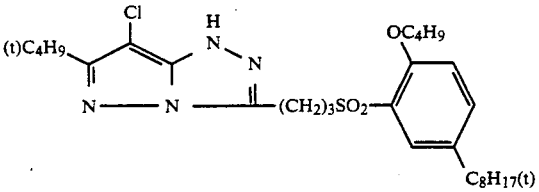
23
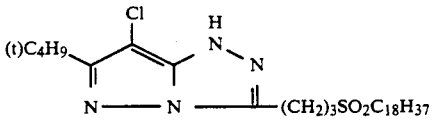
24
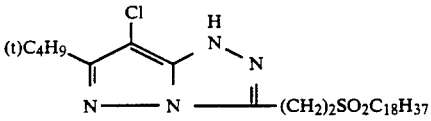
25
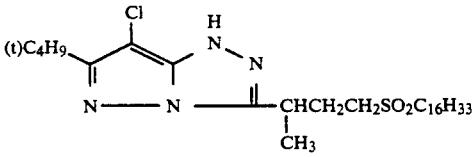
26
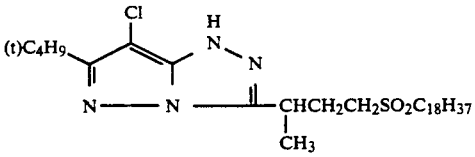
27
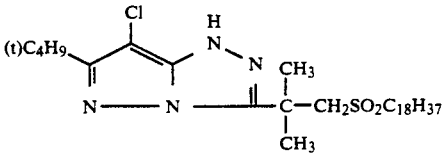

-continued
28
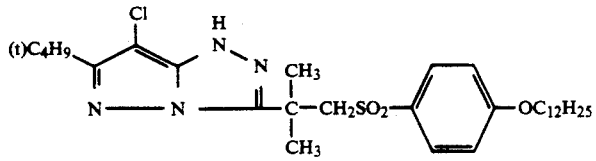
29
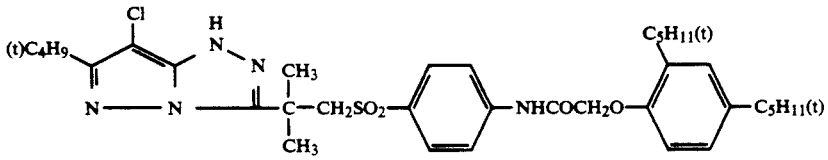
30
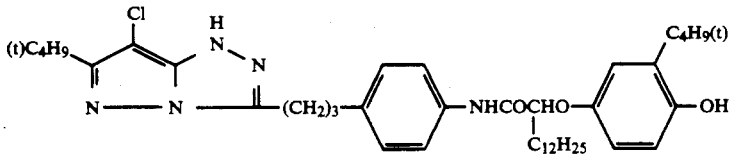
31
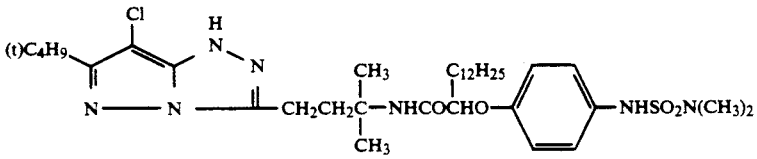
32
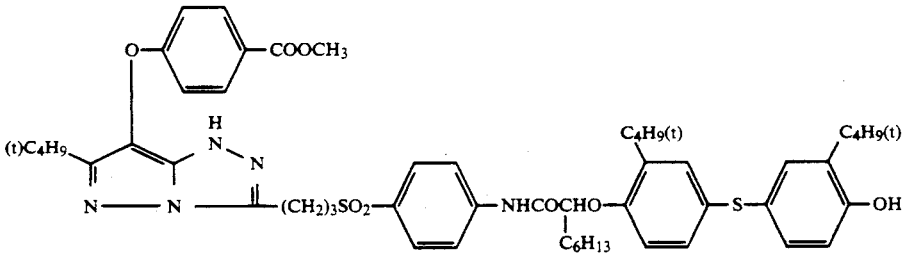
33
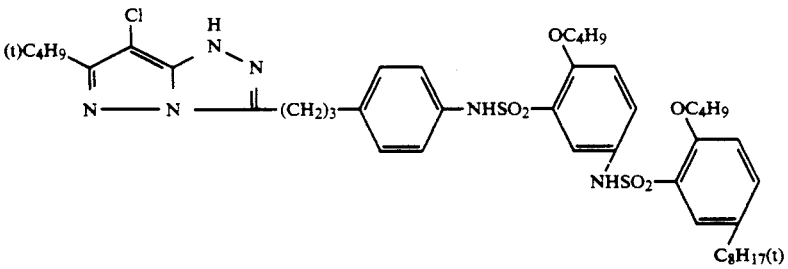
34
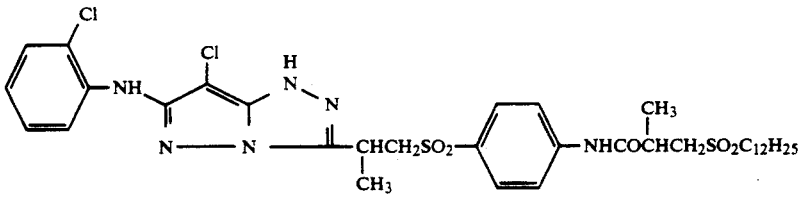
35
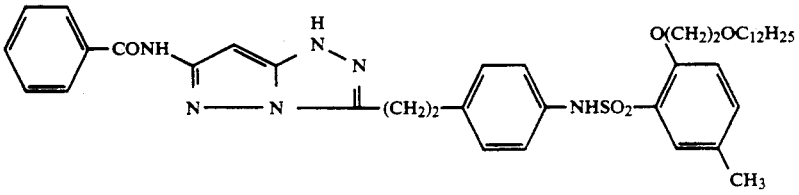

-continued
36
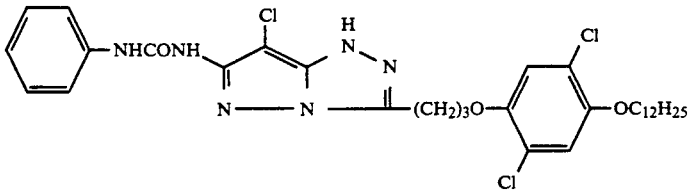
37
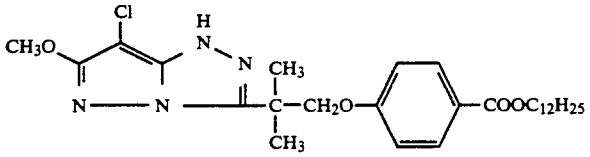
38
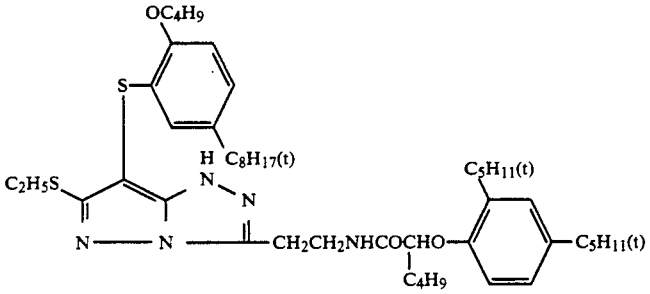
39
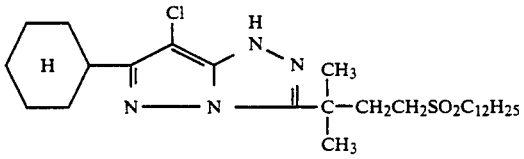
40
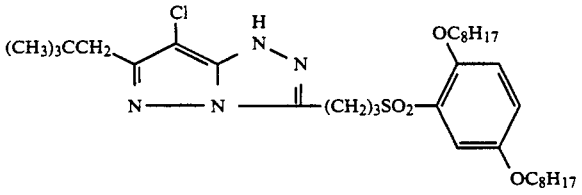
41
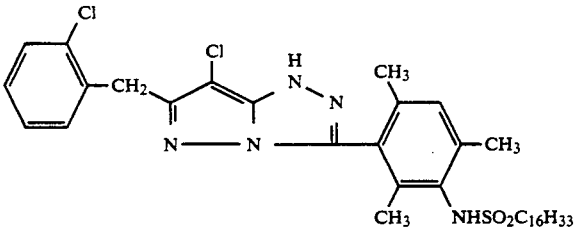
42
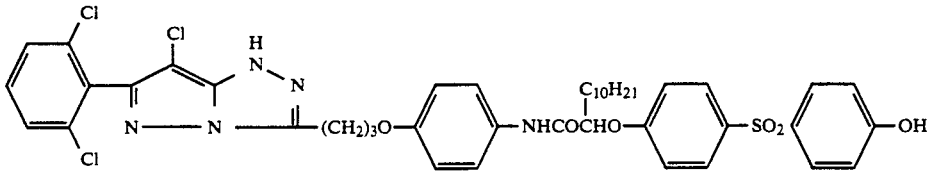

-continued
43
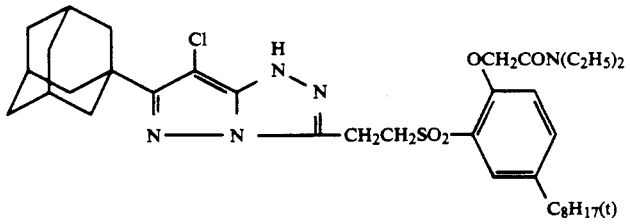
44
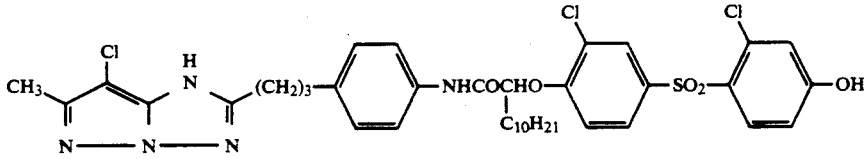
45
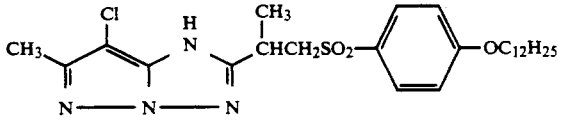
46
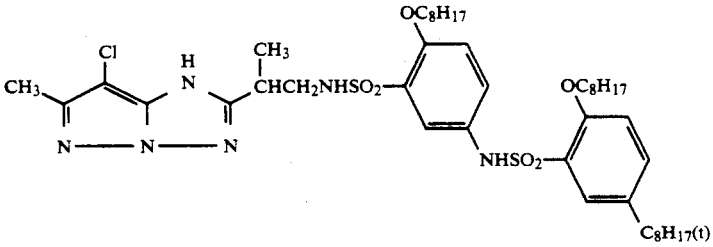
47
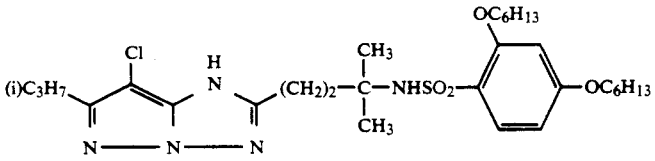
48
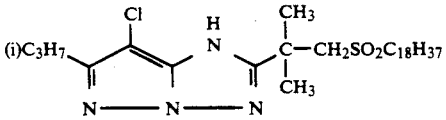
49
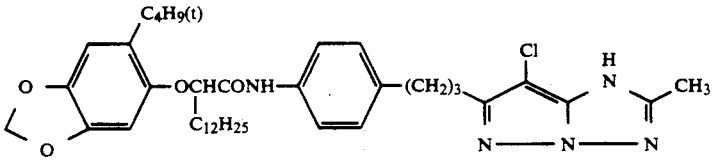
50
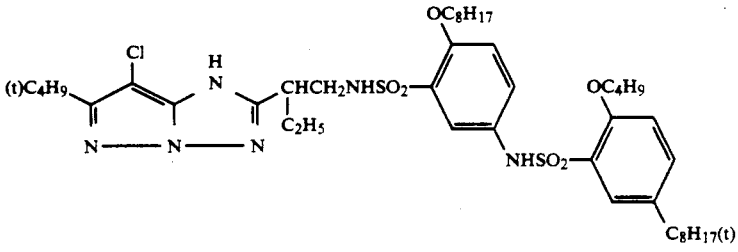

-continued
51
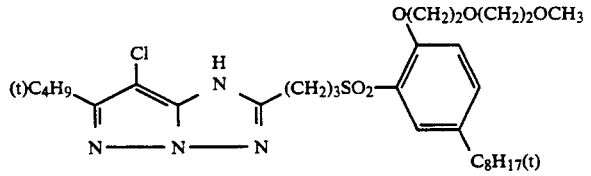
52
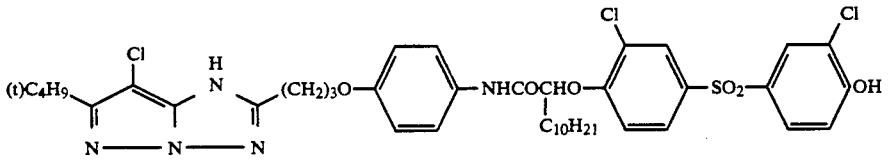
53
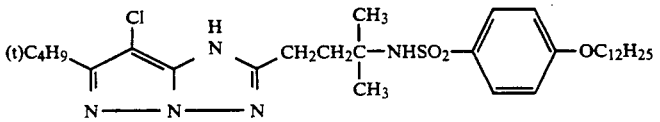
54
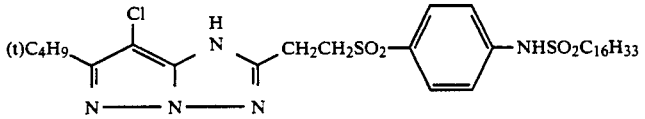
55
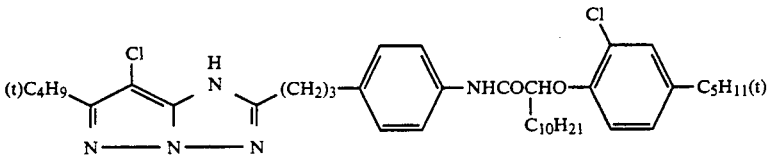
56
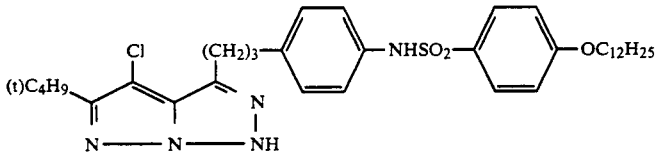
57
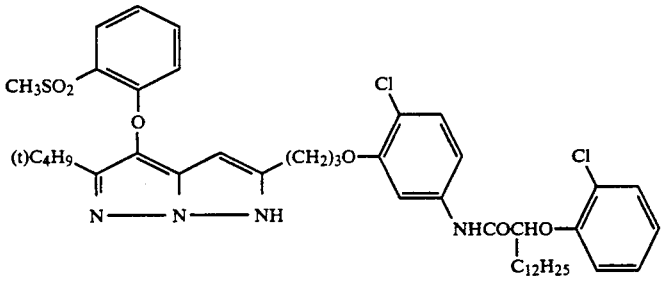
58
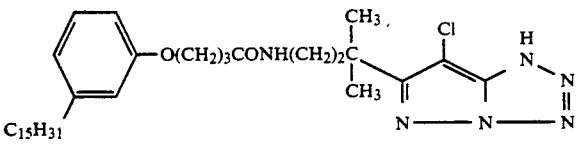

-continued

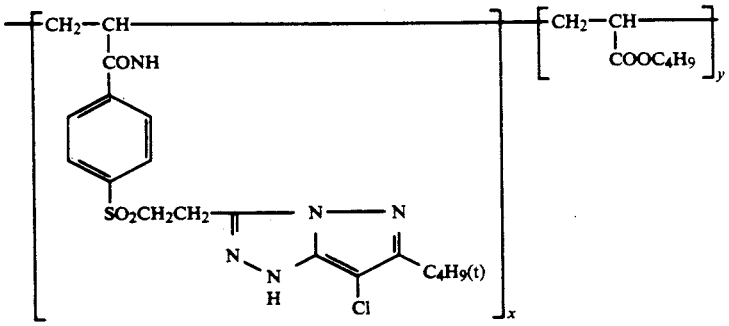

x:y = 50:50

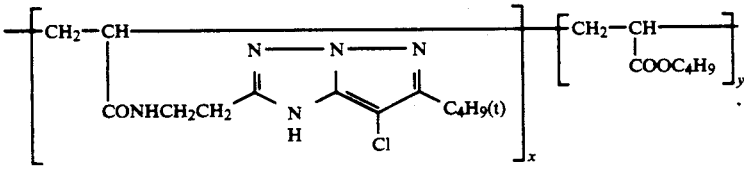

x:y = 50:50

Besides the above, also usable in the invention are Compound Nos. 1 to 4, 6, 8 to 17, 19 to 24, 26 to 43, 45 to 59, 61 to 104, 106 to 121, 123 to 162, 164 to 223 described in Japanese Patent O.P.I. Publication No. 166339/1987.

The magenta couplers represented by Formula M-I can be prepared readily by making reference to Journal of the Chemical Society, Perkin, I (1977), pp 2047-2052, U S. Pat. No. 3,725,067, Japanese Patent O.P.I. Publication Nos. 99437/1984, 42045/1983, 162548/1984, 171956/1984, 33552/1985, 43659/1985, 172982/1985 and 190779/1985.

The magenta couplers of the invention may be employed either alone or in combination, and in a total amount of $1\times10^{-3}$ to 1 mol, preferably $1\times10^{-2}$ to $8\times10^{-1}$ mol, per mol silver halide. The combined use with other couplers is possible.

By using the compounds represented by Formulae A and B (hereinafter referred to as the magenta dye image stabilizers of the invention) in combination with the magenta coupler of the invention, it is possible to prevent a magenta dye image not only from fading but also from discoloring in light.

In Formula A, the examples of the aryl group represented by $R^1$ include phenyl and 1-naphthyl. The aryl group may have a substituent such as those mentioned as the substituent for R in Formula M-I. The examples of the heterocyclic group represented by $R_1$ include 2-furyl and 2-thienyl. The heterocyclic group may have a substituent such as those mentioned as the substituent for R in Formula M-I. $Z_1$ and $Z_2$ each independently represent an alkylene group with 1 to 3 carbon atoms, and the total carbon number of the alkylene groups is 3 to 6. The alkylene group may have a substituent such as those mentioned as the substituent for R in Formula M-I. n represents 1 or 2.

In the invention, of the compounds represented by Formula A, those in which $R_1$ is phenyl, $Z_1$ and $Z_2$ each are ethylene and n is 2 are especially preferred.

The specific examples of the magenta dye image stabilizer represented by Formula A are given below:

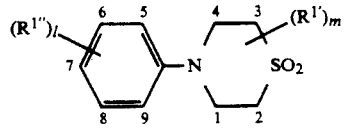

| Compound | $R^{1'}$ | m | $R^{1''}$ | l |
|---|---|---|---|---|
| A-1 | — | 0 | 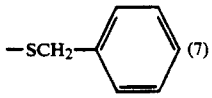 (7) | 1 |
| A-2 | — | 0 | $-OC_{13}H_{27}$(i) (7) | 1 |
| A-3 | — | 0 | $-OC_{18}H_{35}$ (7) | 1 |
| A-4 | — | 0 | $-OC_{14}H_{29}$ (7) | 1 |
| A-5 | — | 0 | $-OC_{16}H_{33}$ (7) | 1 |
| A-6 | — | 0 | $-OC_{16}H_{33}$(i) (7) | 1 |
| A-7 | — | 0 | $-OC_{12}H_{25}$ (7) | 1 |
| A-8 | — | 0 | 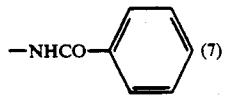 (7) | 1 |
| A-9 | — | 0 | $-OCH_3$ (6,8) | 2 |
| A-10 | — | 0 | $-N(C_2H_5)(C_8H_{17})$ (7) | 1 |
| A-11 | — | 0 | $-C_{12}H_{25}$ (7), —Cl (6) | 2 |
| A-12 | — | 0 | $-OC(=O)C_{13}H_{27}$ (7) | 1 |
| A-13 | — | 0 | $-C_{12}H_{25}$ (7) | 1 |
| A-14 | — | 0 | $-NHCOOC_{12}H_{25}$ (5) | 1 |
| A-15 | $-CH_3$(1,1,4,4) | 4 | $-OC_{12}H_{25}$ (7) | 1 |
| A-16 | $-CH_3$(2,2,3,3) | 4 | $-OC_{18}H_{35}$ (7) | 1 |

wherein $R^{1'}$ is the alkyl, $R^{1''}$ is alkoxy, alkyl, alkylthio, amido, ureido, or halogen, m is an integer from 0 to 4, l is an integer of 1 or 2.

| Compound | $R^{1'}$ | m | $R^{1''}$ | l |
|---|---|---|---|---|
| | 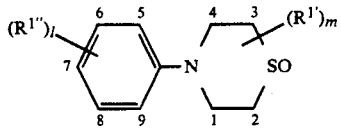 | | | |
| A-17 | — | 0 | $-OC_{12}H_{25}$ (7) | 1 |
| A-18 | — | 0 | 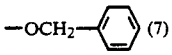 (7) | 1 |
| A-19 | — | 0 | $-NHSO_2C_{18}H_{37}$ (5) | 1 |
| A-20 | $-CH_2OH$ (1) | 1 | $-OCC_{13}H_{27}$ (6) ‖ O | 1 |
| A-21 | $-CH_3$ (2,2,3,3) | 4 | $-OC_{12}H_{25}$ (7) | 1 |
| | 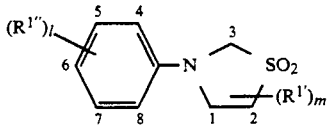 | | | |
| A-22 | — | 0 | $-OC_{14}H_{29}$ (6) | 1 |
| A-23 | — | 0 | $-OC_2H_5$ (5,7) | 2 |
| A-24 | — | 0 | 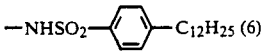 $-C_{12}H_{25}$ (6) | 1 |
| A-25 | $-OC_2H_5$ (1) | 1 | $-C_{12}H_{25}$ (4) | 1 |
| A-26 | $-CH_3$(3,3) | 2 | 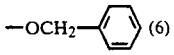 (6) | 1 |
| A-27 | — | 0 | $-OC_{12}H_{25}$ (6) | 1 |

The following compounds are also employable as the magenta dye stabilizer A.

A-28

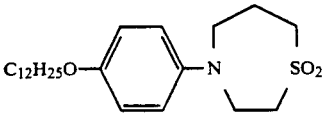

A-29

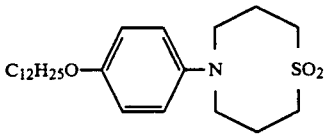

A-30

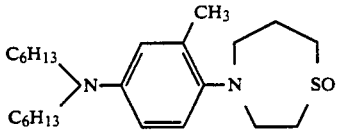

A-31

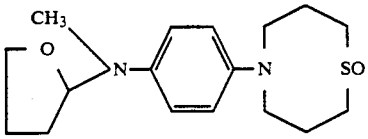

-continued

A-32

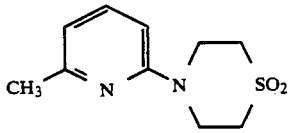

A-33

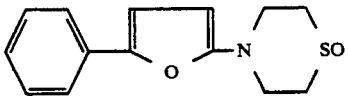

Compounds represented by the Formula A are disclosed in Japanese Patent O.P.I. No. 63/220140(1983) and synthesized according to this Japanese Patent O.P.I.

In Formula B, A represents a straight or branched alkylene group, each of which the straight structure has 1 to 6 carbon atoms.

The alkylene group may have one or more substituents, and the examples of the substituent include aryl, cyano, halogen, heterocycle, cycloalkyl, alkoxy, hydroxy and aryloxy.

In the alkylene group, the alkylene chain itself may form a cycloalkyl ring, such as

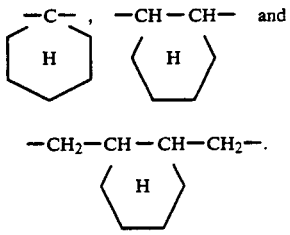

In Formula B the examples of the alkyl, cycloalkyl, alkenyl and aryl groups represented by $R_{12}$ and $R_{13}$ include those mentioned as the examples of R in Formula M-I Also, the examples of the halogen atom, alkyl, cycloalkyl, alkenyl, alkoxy, aryl, aryloxy, alkylthio, arylthio, acyl, acylamino, sulfonyl and sulfoneamide represented by $R_{14}$ and $R_{15}$ in Formula B include those mentioned as the examples of R in Formula M-I.

The above groups each may be substituted by a substituent such as halogen, alkyl, alkenyl, alkoxy, aryloxy, hydroxy, alkoxycarbonyl, aryloxycarbonyl, alkylamino, arylamino, acylamino, carbamoyl, sulfoneamide and sulfamoyl.

Of the compounds represented by Formula B, preferred are those in which $R_{12}$ and $R_{13}$ each are hydrogen, alkyl or cycloalkyl, $R_{14}$ and $R_{15}$ each are hydrogen, alkyl, alkoxy or hydroxy, n is an integer of 0 to 2, and A is a substituted or unsubstituted methylene group.

The representative examples of the compound represented by Formula B are given below:

B-1

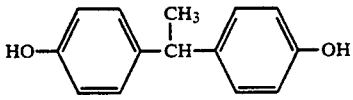

B-2

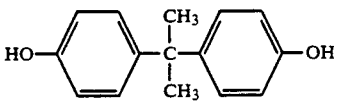

-continued
B-3
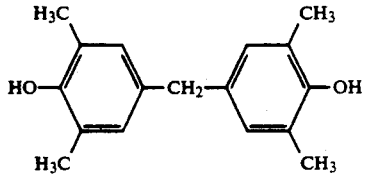
B-4
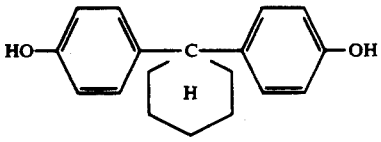
B-5
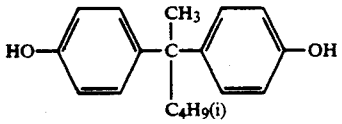
B-6
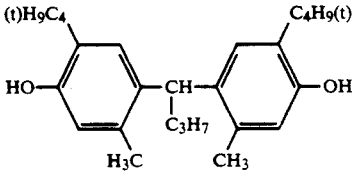
B-7
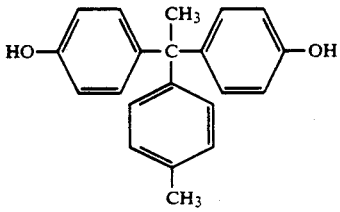
B-8
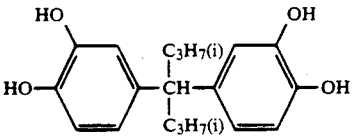
B-9
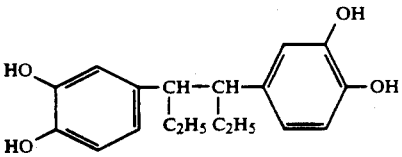
B-10
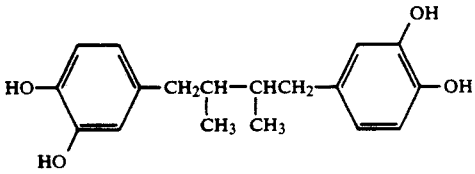
B-11
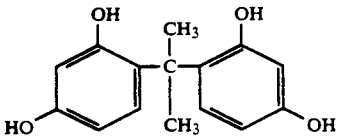
B-12
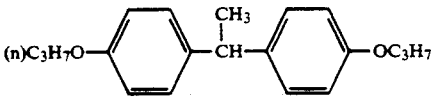
-continued
B-13
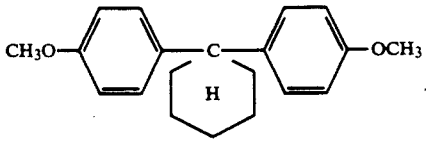
B-14
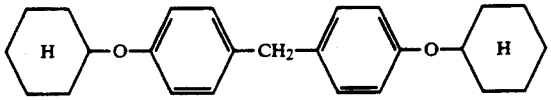
B-15
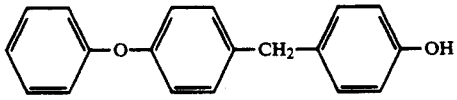
B-16
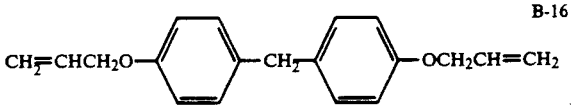
B-17
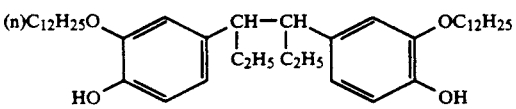
B-18
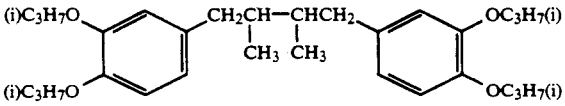
B-19
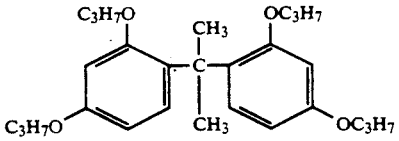
B-20
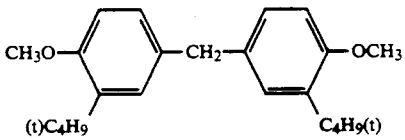
B-21
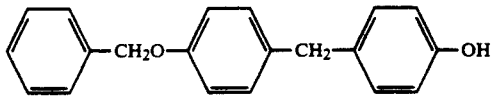
B-22
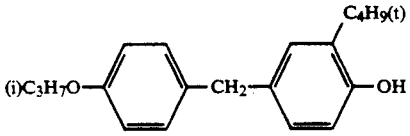
B-23
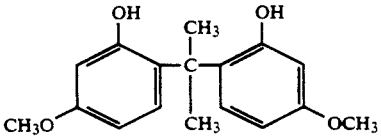

-continued

B-24

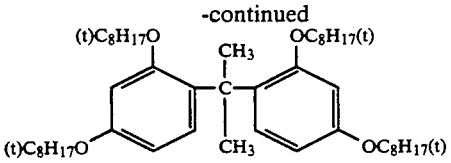

B-25

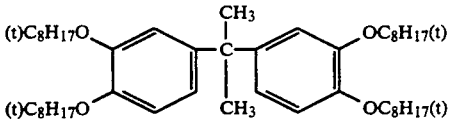

The magenta dye image stabilizer of the invention can be prepared typically by the following method:

PREPARATION EXAMPLE-1 (COMPOUND A-3)

27 g of p-dodecyloxyaniline and 15 g of divinylsulfone were dissolved in 200 ml of ethanol. The mixture was refluxed with boiling for 3 hours, and then cooled on ice. Precipitated crystals were separated by filtration, and subjected to recrystallization from methonol to obtain 18 g of white, scale-like crystals. The structure of these crystals were confirmed by mass spectrum and nuclear magnetic resonance spectrum.

PREPARATION EXAMPLE-2 (COMPOUND A-18)

20 g of p-benzyloxyaniline and 13 g of divinylsulfoxide were dissolved in 150 ml of dioxane. The mixture was refluxed with boiling for 5 hours, and then allowed to stand at room temperature for 24 hours. Precipitated crystals were separated by filtration, and subjected to recrystallization from ethanol to obtain 18 g of white, powder crystals. The structure of these crystals were confirmed by mass spectrum and nuclear magnetic resonance spectrum.

The compounds represented by Formula B include those described in Japanese Patent Examined Publication No. 31625/1973, Japanese Patent O.P.I. Publication Nos. 26133/1973 and 124926/1976, and can be prepared by methods described in these publications. Each of these publications contains a description to the effect that the compound represented by Formula B has a property of improving the light fastness of a dye formed from a photographic coupler, in particular, a pyrazolone-based magenta coupler.

The compound represented by Formula A can improve the light fastness of a magenta dye when used in combination with the magenta coupler represented by Formula M-I, however, when used in an excessive amount, allows Y-stains to be formed in the non-color-forming portion of a light-sensitive material when the light-sensitive material is exposed to heat or moisture.

It is found that the formation of such Y-stains can be effectively prevented by the combined use of the compound represented by Formula B with the compound represented by Formula A.

Each of the magenta dye image stabilizers A and B may be employed either alone or in combination. There is no restriction as to the amount, but the stabilizer A is preferably be employed in an amount of 10 to 200 mol %, more preferably 50 to 150 mol %, relative to the amount of the stabilizer B. The total amount of the stabilizers A and B is preferably 5 to 300 mol %, more preferably 10 to 250 mol %, relative to the amount of the magenta coupler M-I.

It is preferred that the magenta coupler M-I and the magenta dye stabilizers A and B are contained in the same layer. The stabilizers A and B may be present together in a layer adjacent to the layer that contains the magenta coupler M-I of the invention, or may be present separately in two different layers adjacent to the magenta coupler-containing layer.

The magenta coupler and magenta dye stabilizers of the invention, each being hydrophobic, can be added to a silver halide light-sensitive material by various methods including the solid dispersion method, the latex dispersion method and the oil-in-water type emulsification method. The oil-in-water type emulsification method comprises dissolving a hydrophobic additive such as a magenta coupler in a high-boiling point solvent having a boiling point of not lower than 150° C., or, if need arises, in a mixture of the high-boiling solvent, a low-boiling point solvent and/or a water-soluble organic solvent, emulsifying the resultant in a hydrophilic binder such as an aqueous gelatin solution with a surfactant, followed by addition to a desired hydrophilic colloidal layer.

Compounds of A and B are preferably contained in the same oil droplet of high boiling organic solvent, and more preferably they are contained in the same oil droplet that the magenta coupler of M-1 is contained.

Together with the magenta dye image stabilizers of the invention, it is possible to employ phenol and phenylether compounds described in Japanese Patent O.P.I. Publication No. 188344/1986 (compounds represented by Formula XIII). In this case, the phenol or phenylether compound is employed preferably in an amount of not more than 200 mo 1%, more preferably not more than 140 mol %, relative to the total amount of the magenta dye image stabilizers of the invention.

The phenol and phenylether compounds can prevent a magenta dye image formed by the magenta coupler of the invention from fading, but can hardly prevent it from discoloration. In this respect, it is not preferable to employ these compounds in an excessive amount relative to the amount of the magenta dye stabilizers of the invention.

A magenta dye image formed by the magenta coupler M-I of the invention not only fades but also changes its magenta color to yellow when exposed to light.

The magenta dye image stabilizers of the invention can be distinguished from the preceding phenol and phenylether compounds in their effect of preventing a magenta dye image from both fading and discoloration.

When the phenol or phenylether compound is employed in combination with the magenta dye image stabilizer of the invention, the amount should be determined carefully so that the discoloration of a dye in light is not aggravated by its use. The use of a suitable amount of the phenol or phenylether compound together with the magenta dye image stabilizer of the invention may bring about some synergitical effects.

The silver halide photographic light-sensitive material of the invention can be used as a color negative film, a color positive film or color photographic printing paper. The effects of the invention can be most satisfactorily produced when the invention is applied to color printing paper for visual appreciation.

A silver halide emulsion to be used in the light-sensitive material of the invention may contain any conventional silver halide such as silver bromide, silver iodobromide, silver iodochloride, silver chlorobromide and silver chloride.

The silver halide emulsion of the invention may be chemically sensitized by various sensitization methods including the sulfur sensitization method, the selenium sensitization method, the reduction sensitization method and the noble metal sensitization method.

The silver halide emulsion of the invention can be spectrally sensitized to a prescribed wavelength region with a conventional sensitizing dye.

The silver halide light-sensitive material of the invention may contain various additives including a color fogging preventing agent, a hardener, a plasticizer, a polymer latex, an UV absorber, a formalin scavenger, a mordant, a development accelerator, a development retarder, a fluorescent bleaching agent, a matting agent, a lubricant, an anti-static agent and a surfactant.

The silver halide light-sensitive material of the invention is subjected to color developing to obtain a color image.

EXAMPLES

Example 1

On a paper support with both sides thereof being coated with polyethylene, applied was a coating solution prepared by dissolving gelatin (12.0 mg/100 $cm^2$), the magenta coupler of the invention (Example compound 1: 4.1 mg/100 $cm^2$) and 2.5-di-t-octylhydroquinone (0.2 mg/100 $cm^2$) in tricresylphosphate (4.0 mg/100 $cm^2$), followed by emulsification, and then mixing this emulsion with a silver chlorobromide emulsion (silver bromide content: 80 mol %, the amount of silver: 3.8 mg/100 $cm^2$). After drying, Sample No. 1 was obtained.

Sample Nos. 8, 15 and 22 were prepared in substantially the same manner as mentioned above, except that the kind of the magenta coupler was changed (4, 9 and 20 for Sample Nos. 8, 15 and 22, respectively).

Sample Nos. 2, 3, 4 and 5 were prepared in substantially the same manner as in the preparation of Sample No. 1, except that the magenta dye image stabilizer of the invention was added (A-3, A-17, B-6 and B-22 for Sample Nos. 2, 3, 4 and 5, respectively). The amount of the stabilizer was twice the amount of the magenta coupler, in terms of mol%.

A series of samples (Sample Nos. 9, 10, 11 and 12), another series of samples (Sample Nos. 16, 17, 18 and 19) and still another series of samples (Sample Nos. 23, 24, 25 and 26) were respectively prepared in substantially the same manner as in the preparation of Sample Nos. 8, 15 and 22, except for the use of the magenta dye image stabilizer of the invention (A-3 for Sample Nos. 9 and 16 and 23, A-17 for Sample Nos. 10, 17 and 24, B-6 for Sample Nos. 11, 18 and 25, and B-22 for Sample Nos. 12, 19 and 26). Further, a pair of samples (Sample Nos. 6 and 7), another pair of samples (Sample Nos. 13 and 14), still another pair of samples (Sample Nos. 20 and 21) and further pair of samples (Sample Nos. 27 and 28) were respectively prepared in substantially the same manner as in the preparation of Sample Nos. 1, 8, 15 and 22, except for the addition of two different kinds of the magenta dye stabilizer (the kind and combination of the stabilizer are shown in Table 1). In the above, the amount of the stabilizer or the stabilizers was twice the amount of the magenta coupler, in terms of mol %.

Each of the above samples was exposed to light through an optical wedge, and subjected to the following processing.

| Processing | Temperature | Duration |
|---|---|---|
| Color developing | 33° C. | 3 min. 30 sec. |
| Bleaching/fixing | 33° C. | 1 min. 30 sec. |
| Rinsing | 33° C. | 3 min. |
| Drying | 50 to 80° C. | 2 min. |

The processing liquids had the following compositions:

| [Color developer] | |
|---|---|
| Benzyl alcohol | 12 ml |
| Diethylene glycol | 10 ml |
| Potassium carbonate | 25 g |
| Sodium bromide | 0.6 g |
| Anhydrous sodium sulfite | 2.0 g |
| Hydroxyamine sulfate | 2.5 g |
| N-ethyl-N-β-methanesulfoneamidoethyl-3-methyl-4-aminoaniline sulfate | 4.5 g |

Water was added to make the total quantity 1 l, and pH was adjusted to 10.2 with sodium hydroxide.

| [Bleach-fixer] | |
|---|---|
| Ammonium thiosulfate | 120 g |
| Sodium metabisulfite | 15 g |
| Anhydrous sodium sulfite | 3 g |
| Ferric ammonium ethylenediaminetetraacetate | 65 g |

Water was added to make the total quantity 1 l, and pH was adjusted to 6.7 to 6.8.

As to each processed sample Nos. 1 to 26, the density of an image was measured by means of a densitometer (KD-7R, manufactured by Konica Corp) under the conditions mentioned below.

Each sample was exposed to arc light emitted from a xenon fade-o-meter for 10 days to examine the light fastness of a dye image and the formation of Y-stains in the non-color-forming portion. Further, each sample was left at 60° C. and 80% RH for 14 days to examine the fastness of a dye image to moisture and the formation of Y-stains in the non-color-forming portion. The results obtained are shown in Table 1.

"Dye remaining ratio", "Y-S" and "Discoloration ratio" shown in Table 1 are each defined as follows:

Dye Remaining Ratio

Defined as the percentage of the density of a dye after the test to the initial density (1.0).

Y-S

Defined as a difference between the density of a Y-stain before the test and that after the test.

Discoloration Ratio

Defined as a difference between the yellow density/-magenta density ratio before the test and that after the test in the inital density (10). A larger discoloration ratio suggests that a magenta dye is more subject to discoloration and tends to change its color from magenta to yellowish magenta.

TABLE 1

| Sample No. | Coupler | Dye image stabilizer, (amount relative to that of coupler, mol %) | Light fastness: Dye remaining ratio | Light fastness: Y-S | Light fastness: Discoloration ratio | Moisture fastness: Dye remaining ratio | Moisture fastness: Y-S |
|---|---|---|---|---|---|---|---|
| 1 (Comp.) | M-1 | — | 22 | 0.03 | 0.63 | 101 | 0.04 |
| 2 (Comp.) | M-1 | A-3 (200) | 66 | 0.09 | 0.24 | 98 | 0.08 |
| 3 (Comp.) | M-1 | A-17 (200) | 67 | 0.09 | 0.21 | 96 | 0.10 |
| 4 (Comp.) | M-1 | B-6 (200) | 62 | 0.04 | 0.17 | 102 | 0.06 |
| 5 (Comp.) | M-1 | B-22 (200) | 63 | 0.05 | 0.18 | 101 | 0.05 |
| 6 (Inv.) | M-1 | A-3 (100)<br>B-6 (100) | 75 | 0.03 | 0.12 | 98 | 0.05 |
| 7 (Inv.) | M-1 | A-17 (100)<br>B-22 (100) | 74 | 0.03 | 0.14 | 100 | 0.04 |
| 8 (Comp.) | M-4 | — | 22 | 0.02 | 0.59 | 102 | 0.05 |
| 9 (Comp.) | M-4 | A-3 (200) | 65 | 0.09 | 0.25 | 98 | 0.10 |
| 10 (Comp.) | M-4 | A-17 (200) | 65 | 0.10 | 0.26 | 98 | 0.11 |
| 11 (Comp.) | M-4 | B-6 (200) | 63 | 0.05 | 0.20 | 100 | 0.08 |
| 12 (Comp.) | M-4 | B-22 (200) | 65 | 0.05 | 0.18 | 101 | 0.08 |
| 13 (Inv.) | M-4 | A-3 (100)<br>B-6 (100) | 74 | 0.03 | 0.12 | 101 | 0.06 |
| 14 (Inv.) | M-4 | A-17 (100)<br>B-22 (100) | 75 | 0.03 | 0.12 | 99 | 0.06 |
| 15 (Comp.) | M-9 | — | 25 | 0.02 | 0.60 | 102 | 0.04 |
| 16 (Comp.) | M-9 | A-3 (200) | 68 | 0.12 | 0.23 | 98 | 0.10 |
| 17 (Comp.) | M-9 | A-17 (200) | 69 | 0.09 | 0.22 | 99 | 0.10 |
| 18 (Comp.) | M-9 | B-6 (200) | 66 | 0.06 | 0.19 | 99 | 0.07 |
| 19 (Comp.) | M-9 | B-22 (200) | 65 | 0.06 | 0.20 | 101 | 0.06 |
| 20 (Inv.) | M-9 | A-3 (100)<br>B-6 (100) | 75 | 0.03 | 0.13 | 99 | 0.04 |
| 21 (Inv.) | M-9 | A-17 (100)<br>B-22 (100) | 77 | 0.02 | 0.12 | 97 | 0.05 |
| 22 (Comp.) | M-20 | — | 27 | 0.03 | 0.63 | 102 | 0.04 |
| 23 (Comp.) | M-20 | A-3 (200) | 66 | 0.11 | 0.22 | 98 | 0.09 |
| 24 (Comp.) | M-20 | A-17 (200) | 62 | 0.10 | 0.20 | 97 | 0.11 |
| 25 (Comp.) | M-20 | B-6 (200) | 60 | 0.05 | 0.17 | 102 | 0.07 |
| 26 (Comp.) | M-20 | B-22 (200) | 65 | 0.04 | 0.19 | 99 | 0.05 |
| 27 (Inv.) | M-20 | A-3 (100)<br>B-6 (100) | 74 | 0.03 | 0.12 | 97 | 0.05 |
| 28 (Inv.) | M-20 | A-17 (100)<br>B-22 (100) | 76 | 0.03 | 0.14 | 99 | 0.05 |

Comp. . . . Comparative
Inv. . . . Inventive

The results shown in Table clearly reveal that Sample Nos. 6, 7, 13, 14, 21, 22, 27 and 28, each prepared by using the dye image stabilizers A and B in combination, were more improved in the fastness of a dye image and less subject to Y-stain formation, as compared with Sample Nos. 2, 3, 4, 5, 8, 9, 10, 11, 12, 16, 17, 18, 19, 22, 23, 24, 25 and 26, each prepared by using the dye image stabilizers A and B separately. By the combined use of the dye image stabilizers A and B, the formation of Y-stains in the non-color-forming portion was minimized, and a magenta dye image was prevented effectively from fading and discoloration.

EXAMPLE 2

Sample Nos. 29 to 45 were prepared in substantially the same manner as in Example 1, except that the type and combination of the magenta coupler and the dye image stabilizers were varied to those shown in Table 2. These samples were examined for fading, discoloration and Y-stain formation by the same methods as in Example 1. The results obtained are shown in Table 2.

TABLE 2

| Sample No. | Coupler | Dye image stabilizer, (amount relative to that of coupler, mol %) | Light fastness: Dye remaining ratio | Light fastness: Y-S | Light fastness: Discoloration ratio | Moisture fastness: Dye remaining ratio | Moisture fastness: Y-S |
|---|---|---|---|---|---|---|---|
| 29 (Comp.) | M-2 | A-6 (200) | 63 | 0.05 | 0.21 | 97 | 0.06 |
| 30 (Comp.) | M-2 | A-2 (200) | 60 | 0.11 | 0.23 | 98 | 0.05 |
| 31 (Comp.) | M-2 | B-9 (200) | 60 | 0.11 | 0.21 | 97 | 0.05 |
| 32 (Comp.) | M-2 | B-17 (200) | 57 | 0.09 | 0.19 | 100 | 0.04 |
| 33 (Comp.) | M-2 | B-22 (200) | 56 | 0.07 | 0.20 | 98 | 0.05 |
| 34 (Comp.) | M-2 | B-2 (200) | 53 | 0.05 | 0.21 | 101 | 0.03 |
| 35 (Comp.) | M-2 | B-12 (200) | 50 | 0.03 | 0.20 | 101 | 0.05 |
| 36 (Comp.) | M-2 | B-15 (200) | 55 | 0.06 | 0.18 | 99 | 0.04 |
| 37 (Comp.) | M-2 | B-22 (200) | 57 | 0.05 | 0.21 | 100 | 0.04 |
| 38 (Inv.) | M-2 | A-6 (100)<br>B-22 (100) | 71 | 0.03 | 0.12 | 101 | 0.02 |
| 39 (Inv.) | M-2 | A-6 (100)<br>B-2 (100) | 67 | 0.03 | 0.11 | 99 | 0.02 |
| 40 (Inv.) | M-2 | A-6 (100)<br>B-12 (100) | 68 | 0.03 | 0.12 | 99 | 0.02 |
| 41 (Inv.) | M-2 | A-6 (100)<br>B-15 (100) | 70 | 0.04 | 0.12 | 101 | 0.03 |

TABLE 2-continued

| Sample No. | Coupler | Dye image stabilizer, (amount relative to that of coupler, mol %) | Light fastness: Dye remaining ratio | Light fastness: Y-S | Light fastness: Discoloration ratio | Moisture fastness: Dye remaining ratio | Moisture fastness: Y-S |
|---|---|---|---|---|---|---|---|
| 42 (Inv.) | M-2 | B-22 (100)<br>A-2 (100) | 68 | 0.03 | 0.13 | 100 | 0.02 |
| 43 (Inv.) | M-2 | B-22 (100)<br>A-9 (100) | 69 | 0.04 | 0.10 | 98 | 0.02 |
| 44 (Inv.) | M-2 | B-22 (100)<br>A-17 (100) | 66 | 0.03 | 0.11 | 99 | 0.01 |
| 45 (Inv.) | M-2 | B-22 (100)<br>A-22 (100) | 63 | 0.03 | 0.11 | 100 | 0.03 |

Comp. . . . Comparative
Inv. . . . Inventive

It is evident from Table 2 that, as compared with Sample Nos. 29 to 37, each prepared by using only one of the magenta dye stabilizers A and B, Sample Nos. 38 to 45, each prepared by using both of the stabilizers A and B, were more improved in the fastness of a dye image to light, and were more resistant to heat and moisture to be almost free from Y-stain formation.

By the combination of the dye image stabilizers A and B of the invention, the problems of fading, discoloration and Y-stain formation, the solution of which has long been awaited, can be eliminated considerably.

EXAMPLE 3

A silver halide color photographic multilayer light-sensitive material (Sample No. 46) was prepared by providing in sequence the following layers on a paper support with both sides thereof being coated with polyethylene. In the following, the amount of a silver halide was expressed as the amount of silver.

| | |
|---|---|
| 1st Layer: Blue-sensitive silver halide emulsion layer | |
| α-pyvaloyl-α-(2,4-dioxo-1-benzylimidazolidine-3-il)-2-chloro-5-[γ-(2,4-di-t-amylphenoxy) butylamide] acetoanilide | 6.8 mg/100 cm$^2$ |
| Blue-sensitive silver chlorobromide emulsion containing 85 mol % of silver bromide | 3.2 mg/100 cm$^2$ |
| Dibutyl phthalate | 3.5 mg/100 cm$^2$ |
| Gelatin | 13.5 mg/100 cm$^2$ |
| 2nd Layer: Intermediate layer | |
| 2,5-di-octylhydroquinone | 0.5 mg/100 cm$^2$ |
| Dibutyl phthalate | 0.5 mg/100 cm$^2$ |
| Gelatin | 9.0 mg/100 cm$^2$ |
| 3rd Layer: Green-sensitive silver halide emulsion layer | |
| Magenta coupler 1 | 3.5 mg/100 cm$^2$ |
| Green-sensitive silver chlorobromide emulsion containing 801 mol % of silver bromide | 2.5 mg/100 cm$^2$ |
| Dibutyl phthalate | 3.0 mg/100 cm$^2$ |
| Gelatin | 12.0 mg/100 cm$^2$ |
| 4th Layer: Intermediate layer | |
| 2-(2-hydroxyethyl-3-sec-butyl-5-t-butylphenyl) benzotriazole as UV absorbent | 5.0 mg/100 cm$^2$ |
| Di-butylphthalate | 5.0 mg/100 cm$^2$ |
| 2,5-di-t-octylhydroquinone | 0.5 mg/100 cm$^2$ |
| Gelatin | 12.0 mg/100 cm$^2$ |
| 5th Layer: Red-sensitive silver halide emulsion layer | |
| 2-[α-(2,4-di-t-pentylphenoxy) butaneamide]-4,6-dichloro-5-ethylphenol | 4.2 mg/100 cm$^2$ |
| Red-sensitive silver chlorobromide emulsion containing 80 mol % of silver bromide | 3.0 mg/100 cm$^2$ |
| Tricresyl phosphate | 3.5 mg/100 cm$^2$ |
| Gelatin | 11.5 mg/100 cm$^2$ |
| 6th Layer: Protective layer | |
| Gelatin | 8.0 mg/100 cm$^2$ |

Multilayer light-sensitive materials (Sample Nos. 47 to 57) were prepared in substantially the same manner as in the preparation of Sample No. 46, except that the magenta dye image stabilizers A and B of the invention were added to the 3rd layer in the amounts shown in Table 3. The samples were exposed to light and processed in the same manner as in Example 1, and then examined for light fastness by exposing an image to light from a xenon fade-o-meter for 15 days. The results are shown in Table 3.

TABLE 3

| Sample No. | Dye image stabilizer, (amount relative to that of coupler, mol %) | | Magenta dye image remaining ratio (%) |
|---|---|---|---|
| 46 | — | | 21 |
| 47 | A-2 (100) | B-6 (100) | 72 |
| 48 | A-2 (75) | B-6 (125) | 69 |
| 49 | A-2 (50) | B-6 (150) | 60 |
| 50 | A-2 (125) | B-6 (75) | 75 |
| 51 | A-2 (150) | B-6 (50) | 73 |
| 52 | A-6 (100) | B-22 (100) | 71 |
| 53 | A-6 (50) | B-22 (150) | 66 |
| 54 | A-6 (150) | B-22 (50) | 73 |
| 55 | A-17 (100) | B-22 (100) | 63 |
| 56 | A-17 (125) | B-22 (75) | 65 |
| 57 | A-17 (75) | B-22 (125) | 57 |

As is evident from the results, the combined use of the magenta dye image stabilizers A and B of the invention enables a magenta dye formed by the magenta coupler of the invention to be MORE stable. This effect is enhanced when these stabilizers are employed in the optimum amounts as defined in the invention. Sample Nos. 47 to 57 produced dye images that hardly faded by exposure to light from a xenon fade-o-meter, while a dye image formed by Sample No. 46 grew dull in color.

Each sample of the invention could produce a magenta dye that hardly discolored or faded when exposed to light, and had improved color reproducibility due to its improved color balance between magenta, yellow and cyan.

EXAMPLE 4

A multilayered light sensitive silver halide color photographic material Sample 58 was prepared by coating layers shown below onto a paper support at a side of titanium containing polyethylen laminated which support is laminated with polyethylen on one side and with polyethylen containing titanium oxide on the other side. The coating compositions were prepared in the following way.

First layer sixty milliliter of ethyl acetate was added to 26.7 g of a yellow coupler Y-1, 10.0 g and 6.67 g of dye stabilizers ST-1 and ST-2 respectively, 0.67 g of an additive HQ-1, 0.33 g of anti-irradiation dye AI-3 and high boiling solvent DNP to dissolve. The resulted solution was added to 220 ml of 10% aque gelatin solution containing 7 ml of 20% surfactant SU-1 and was emulsified with a supersonic homogenizer to obtain yellow coupler dispersion. The dispersion was mixed with the blue sensitive silver halide emulsion containing 8.68 g of silver to provide the first layer composition.

The 2nd to 7th layer compositions were prepared in the similar manner as the 1st layer according to the description of Table 4. A hardener H-1 was added to the 2nd and 4th layer, and H-2 to the 7th layer.

Coating aids SU-2 and SU-3 were added to adjust surface tension. In Table 4 an amount is shown in gram per 1 $m^2$ of the light sensitive silver halide photographic material when specified by no other way.

TABLE 4

| Layer | Component | Amount added ($g/m^2$) |
|---|---|---|
| 7th (Protect layer) | Gelatin | 1.00 |
| | DIDP | 0.005 |
| | HQ-2 | 0.002 |
| | HQ-3 | 0.002 |
| | HQ-4 | 0.004 |
| | HQ-5 | 0.02 |
| | F-1 | 0.002 |
| 6th (UV absorbing layer) | Gelatin | 0.40 |
| | UV-1 | 0.10 |
| | UV-2 | 0.04 |
| | UV-3 | 0.16 |
| | HQ-5 | 0.04 |
| | DNP | 0.20 |
| | PVP | 0.03 |
| | AI-2 | 0.02 |
| | AI-4 | 0.01 |
| 5th (Red sensitive | Gelatin | 1.30 |
| | Em-R | 0.21 |

TABLE 4-continued

| Layer | Component | Amount added ($g/m^2$) |
|---|---|---|
| layer) | C-1 | 0.17 |
| 5th (Red sensitive layer) | C-2 | 0.25 |
| | ST-1 | 0.20 |
| | HQ-1 | 0.01 |
| | HBS-1 | 0.20 |
| | DOP | 0.20 |
| 4th (UV absorbing layer) | Gelatin | 0.94 |
| | UV-1 | 0.28 |
| | UV-2 | 0.09 |
| | UV-3 | 0.38 |
| | HQ-5 | 0.10 |
| | DNP | 0.40 |
| 3rd (Green sensitive layer) | Gelatin | 1.40 |
| | Em-G | 0.17 |
| | Magenta coupler | 0.23 |
| | DIDP | 0.13 |
| | DBP | 0.13 |
| | AI-1 | 0.01 |
| 2nd (Intermediate layer) | Gelatin | 1.20 |
| | HQ-2 | 0.03 |
| | HQ-3 | 0.03 |
| | HQ-4 | 0.05 |
| | HQ-5 | 0.23 |
| | DIDP | 0.06 |
| | F-1 | 0.002 |
| 1st (Blue sensitive layer) | Gelatin | 1.20 |
| | Em-B | 0.26 |
| | Y-1 | 0.80 |
| | ST-1 | 0.30 |
| | ST-2 | 0.20 |
| | HQ-1 | 0.02 |
| | AI-3 | 0.01 |
| | DNP | 0.20 |
| Support | Polyethylen-laminated paper | |

Amount of silver halide emulsion is shown as a metalic silver.

Y-1

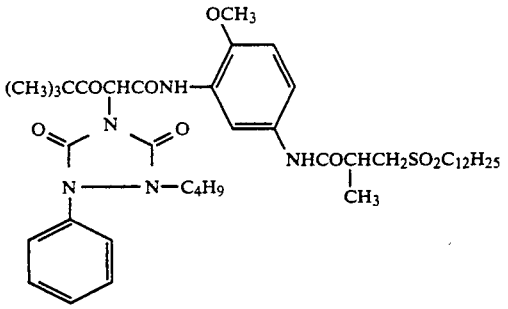

C-1

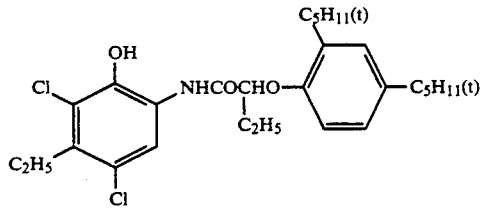

C-2

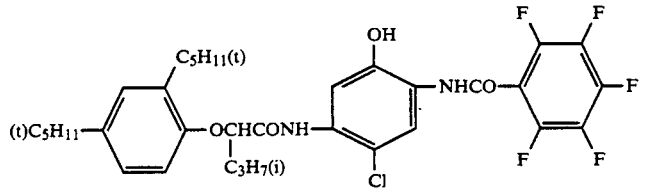

-continued
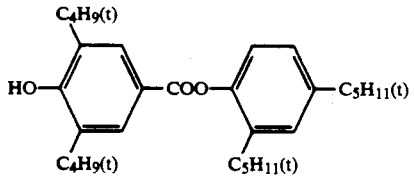
ST-1
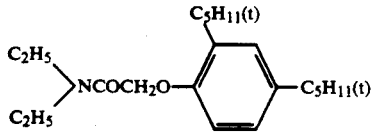
ST-2
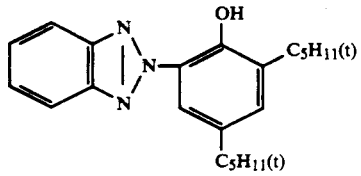
UV-1
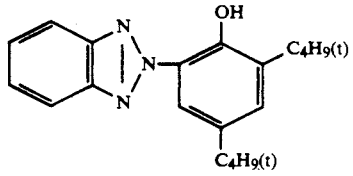
UV-2
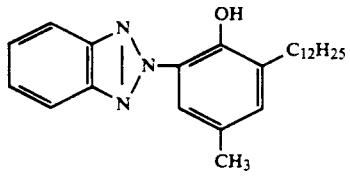
UV-3
DBP: Dibutylphthalate
DOP: Dioctylphthalate
DNP: Dinonylphthalate
DIDP: Diisodethylphthalate
PVP: Polyvinylpyrolidon
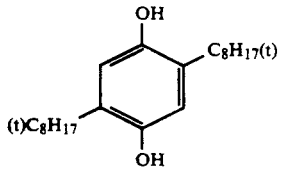
HQ-1
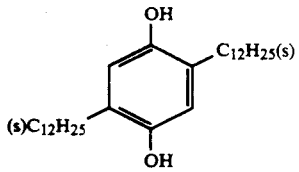
HQ-2
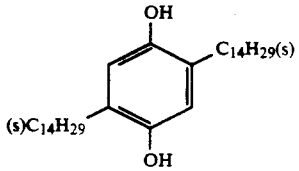
HQ-3

-continued
HQ-4
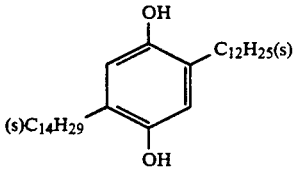
HQ-5
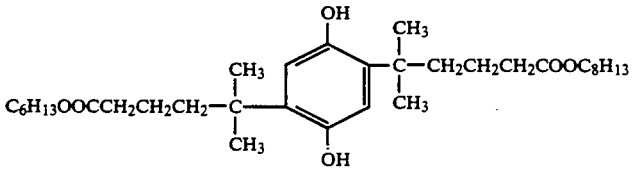
HBS-1
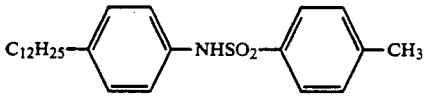
AI-1
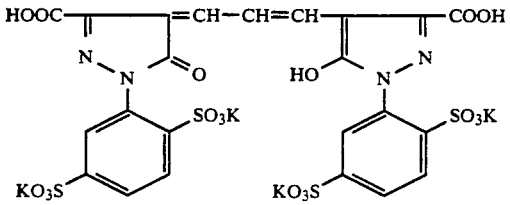
AI-2
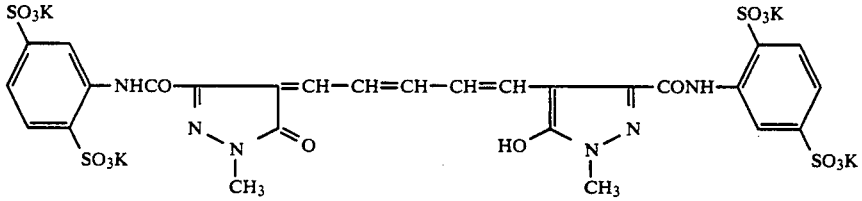
AI-3
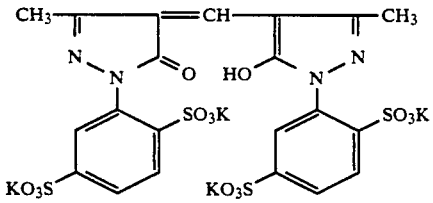
AI-4
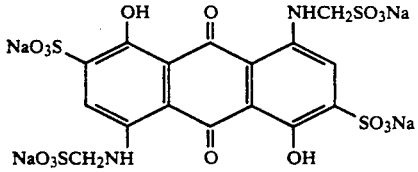
SU-1
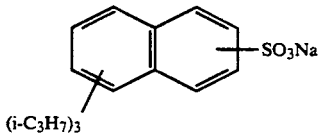
SU-2
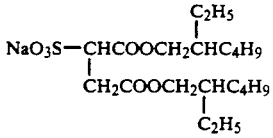

-continued $NaO_3S-CH(CH_2COOCH_2(CF_2CF_2)_2H)COOCH_2(CF_2CF_2)_2H$ SU-3

$C(CH_2SO_2CH{=}CH_2)_4$ H-1

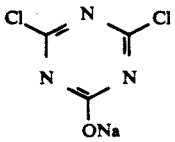

H-2

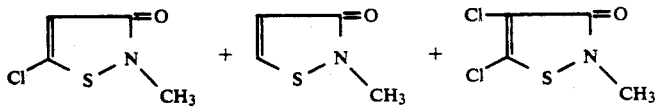

(50%) (46%) (4%) (mol ratio)

Preparation of blue sensitive silver halide emulsion.

To 1000 ml of 2% aqueous gelatin solution being kept at 40° C. solutions A and B were added by double jet method at 6.5 of pAg and 3.0 of pH over 30 min, then solutions C and D were further added at 7.3 of pAg and 5.5 of pH over 180 min by double jet method. The pH was adjusted by sulfuric acid and sodium hydroxide. pAg was adjusted by a mixed halide aqueous solution containing sodium chloride and potassium bromide, whose ratio of chloride ion to bromide ion is 99.8:0.2. The concentration of the solution was 0.1 mol/l when used in addition of A and B solutions and 1 mol/l in addition of C and D solutions.

| | |
|---|---|
| (A solution) | |
| Sodium chloride | 3.42 g |
| Potassium bromide | 0.03 g |
| Water to make up | 200 ml |
| (B solution) | |
| Silver nitrate | 10 g |
| Water to make up | 200 ml |
| (C solution) | |
| Sodium chloride | 102.7 g |
| Potassium bromide | 1.0 g |
| Water to make up | 600 ml |
| (D solution) | |
| Silver nitrate | 300 g |
| Water to make up | 600 ml |

After completion of addition the resultant was desalted by using 5% aqueous solution of Demol N (prepared by Kao Atlas) and 20% aqueous solution of magnesium sulfite, and was mixed with gelatin aqueous solution. Monodispersed cubic silver halide emulsion EMP-1 was obtained which has an average grain size of 0.85 μm, and variation coefficient of grain size distribution $\sigma/\bar{r}$ of 0.07, and contains 99.5 mol % of silver chloride.

EMP-1 was chemically sensitized at 50° C. over 90 min by the following compounds to obtain a blue sensitive silver halide emulsion Em-B.

| | |
|---|---|
| Sodium thiosulfate | 0.8 mg/mol AgX |
| Chloroauric acid | 0.5 mg/mol AgX |
| Stabilizer STAB-1 | $6 \times 10^{-4}$ mol/mol AgX |
| Sensitizing dye BS-1 | $4 \times 10^{-4}$ mol/mol AgX |
| Sensitizing dye BS-2 | $1 \times 10^{-4}$ mol/mol AgX |

Preparation of green sensitive silver halide emulsion.

In the similar way as EMP-1 with proviso that the adding time of solutions A and B, and C and D were changed, monodispersed cubic silver halide emulsion EMP-2 was obtained, which has an average grain size of 0.43 μm, variation coefficient of the grain size distribution $\sigma/\bar{r}$ of 0.08 and contains silver chloride of 99.5 mol %.

EMP-2 was chemically, sensitized at 55° C. over 120 min by using following compound to obtain a green sensitive silver halide emulsion Em-G.

| | |
|---|---|
| Sodium thiosulfate | 1.5 mg/mol AgX |
| Chloroauric acid | 1.0 mg/mol AgX |
| Stabilizer STAB-1 | $6 \times 10^{-4}$ mol/mol AgX |
| Sensitizing dye GS-1 | $4 \times 10^{-4}$ mol/mol AgX |

Preparation of red sensitive silver halide emulsion.

In the similar way as EMF-1 with proviso that the adding time of solutions A and B, and C and D were changed, monodispersed cubic silver halide emulsion EMP-3 was obtained, which has an average grain size of 0.50 μm, variation coefficient of the grain size distribution $\sigma/\bar{r}$ of 0.08 and Contains silver chloride of 99.5 mol %.

EMP-3 was chemically, sensitized at 60° C. over 90 min by using following compound to obtain a red sensitive silver halide emulsion Em-R.

| | |
|---|---|
| Sodium thiosulfate | 1.8 mg/mol AgX |
| Chloroauric acid | 2.0 mg/mol AgX |
| Stabilizer STAB-1 | $6 \times 10^{-4}$ mol/mol AgX |
| Sensitizing dye RS-1 | $1 \times 10^{-4}$ mol/mol AgX |

BS-1

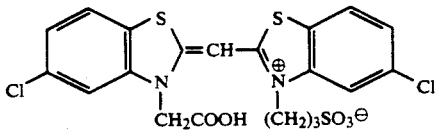

-continued

BS-2

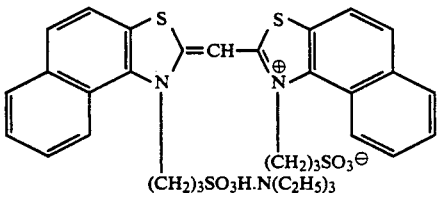

GS-1

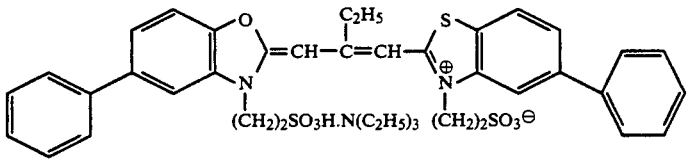

RS-1

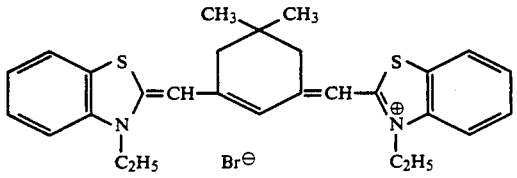

STAB-1

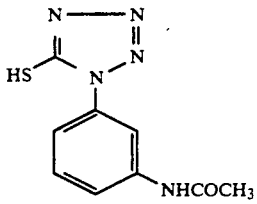

Samples 59 to 72 were prepared same as sample 58 other than that a magenta coupler in the 3rd layer M-61 was preplaced as shown in Table 5 and further dye stabilizer was added as shown Table 5.

The samples 59-72 was wedge wizely exposed to green light by means of photosensitometer KS-7 manufactured by Konica Corp, and processed. The dye stability of samples were tested exposing by xenon fade-ometer for 21 days.

| Processing step | Temperature | Time |
|---|---|---|
| Color development | 35.0 ± 0.3° C. | 45 s |
| Bleach-fixing | 35.0 ± 0.5° C. | 45 s |
| Stabilization | 30–34° C. | 90 s |
| Drying | 60–80° C. | 60 s |

| | |
|---|---|
| [Color developer] | |
| Distilled water | 800 ml |
| Triethanolamine | 10 g |
| N,N-diethylhydroxylamine | 5 g |
| Potassium bromide | 0.02 g |
| Potassium chloride | 2 g |
| Potassium sulfite | 0.3 g |
| 1-hydroxyethylidene-1,1-diphosphonic acid | 1.0 g |
| Ethylenediaminetetraacetic acid | 1.0 g |
| Disodium cathecol-3,5-disalfonic acid | 1.0 g |
| Drethyleneglycol | 10 g |
| N-ethyl-N-β-methanesulfonamideethyl-3-methyl-4-aminoaninline sulfonic acid | 4.5 g |
| Fluorescent brightener (4,4'-diaminostylbene disulfonic acid derivative) | 1.0 g |
| Potassium carbonate | 27 g |
| Water to make up 1 l, pH = 10.10. | |
| [Bleach fixer] | |
| Ferric ammonium ethylenediaminetetraacetate dihydrate | 60 g |
| Ethylenediaminetetraacetic acid | 3 g |
| Ammonium thiosulfate (70% aqueous solution) | 100 ml |

-continued

| | |
|---|---|
| Ammonium thiosulfite (40% aqueous solution) | 27.5 ml |
| Water to make up 1 l. pH is adjusted by means of potassium carbonate or gracial acetic acid to 5.7. | |
| [Stabilizer] | |
| 5-chloro-2-methyl-4-isothiazolin-3-on | 0.2 g |
| 1,2-Benzisothiazolin-3-on | 0.3 g |
| Ethylenglycol | 1.0 g |
| 1-Hydroxyethylidene-1,1-diphosphonic acid | 2.0 g |
| O-phenylphenoln | 1.0 g |
| Ethylenediaminetetraacetic acid | 1.0 g |
| Ammonium hydroxide (20% aqueous solution) | 3.0 g |
| Fluorescent brightener (4,4'-diaminostylbene disulfonic acid derivative) | 1.5 g |
| Water to make up 1 l. pH is adjusted to 7.0 by means of sulfonic acid or potassium hydroxide. | |

Water to make up 1 l. pH is adjusted to 7.0 by means of sulfonic acid or potassium hydroxide.

TABLE 5

| Sample No. | Magenta coupler Exemplified | Amount of dye stabilizer added | Residual ratio of magenta dye |
|---|---|---|---|
| 58 | 61 | — | 24 |
| 59 | 61 | A-2 (200) | 59 |
| 60 | 61 | B-6 (200) | 57 |
| 61 | 61 | A-2 (100), B-6 (100) | 88 |
| 62 | 61 | A-6 (120), B-6 (80) | 82 |
| 63 | 61 | A-2 (100), B-22 (100) | 84 |
| 64 | 61 | A-18 (80), B-6 (120) | 82 |
| 65 | 61 | A-24 (100), B-6 (100) | 86 |
| 66 | 3 | A-2 (100), B-6 (100) | 68 |
| 67 | 12 | A-2 (100), B-6 (100) | 75 |
| 68 | 22 | A-2 (100), B-6 (100) | 86 |
| 69 | 27 | A-2 (100), B-6 (100) | 87 |
| 70 | 30 | A-2 (100), B-6 (100) | 78 |

TABLE 5-continued

| Sample No. | Magenta coupler Exemplified | Amount of dye stabilizer added | Residual ratio of magenta dye |
|---|---|---|---|
| 71 | 46 | A-2 (100), B-6 (100) | 70 |
| 72 | 51 | A-2 (100), B-6 (100) | 76 |

This example illustrates the remarkable effect of magenta dye stabilizer A or B on dye stability against light. Samples 61–65, 68 and 69 are exelent in dye stability.

What is claimed is:

1. A photographic material having a support and a light sensitive silver halide emulsion layer which contains a magenta coupler represented by Formula M-I, a compound represented by Formula A and a compound represented by Formula B:

M-I

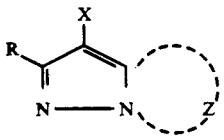

wherein Z represents a group of non-metallic atoms necessary for forming a nitrogen-containing heterocyclic ring which may have a substituent; X represents a hydrogen atom or a group which can be released by a coupling reaction with the oxidized product of a color developing agent; and R represents a hydrogen atom or a substituent,

A

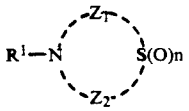

wherein $R_1$ represents an aryl or a heterocyclic group; $Z_1$ and $Z_2$ each represent an alkylene group having 1 to 3 carbon atoms, provided that the total carbon number of the alkylene groups is 3 to 6; and n represents 1 or 2;

B

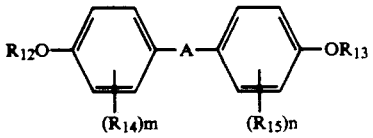

wherein $R_{12}$ and $R_{13}$ each represent a hydrogen atom, an alkyl, cycloalkyl, alkenyl or aryl group; $R_{14}$ and $R_{15}$ each represent a halogen atom, an alkyl, cycloalkyl, alkenyl, alkoxy, aryl, aryloxy, alkylthio, arylthio, acyl, acylamino, sulfonyl, sulfonamide or hydroxy group; m and n each represent an integer of 0 to 4, and when m is an integer of 2 to 4, $R_{14}$ may be either identical with or different from each other, and when n is an integer of 2 to 4, $R_{15}$ may be either identical with or different from each other; and A represents an alkylene group having 1 to 6 carbon atoms in its main chain.

2. A photographic material according to claim 1, wherein the magenta coupler is represented by a Formula M-VIII,

M-VIII

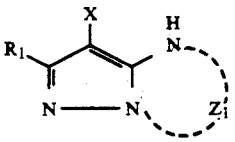

wherein $Z_1$ represents a group of non-metallic atoms necessary for forming a nitrogen-containing 5-member heterocyclic ring which may have a substituent; X represents a hydrogen atom or a group which can be released by a coupling reaction with the oxidized product of a color developing agent; and $R_1$ represents a hydrogen atom or a substituent.

3. A photographic material according to claim 1, wherein the compound represented by formula A is a compound represented by formula

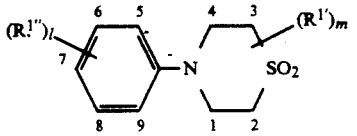

wherein $R^{1''}$ is an alkoxy, alkyl, alkylthio, amido, ureido, or halogen, $R^{1'}$ is an alkyl, m is an integer of 0 to 4, 1 is an integer of 1 or 2.

4. A photographic material according to claim 3, wherein m is zero, $R^{1''}$ is an alkoxy group.

5. A photographic material according to claim 1, wherein $R_{12}$ and $R_{13}$ each are a hydrogen or an alkyl group, $R_{14}$ and $R_{15}$ each are a hydroxy, alkoxy or alkyl group in the formula B.

6. A photographic material according to claim 1, wherein the magenta coupler, a compound represented by formula A and a compound represented by formula B are contained in the same droplet of a high boiling organic solvent which droplet is dispersed in a green sensitive silver halide emulsion layer.

7. A photographic material having a support and a light sensitive silver halide emulsion layer which contains a magenta coupler represented by Formula M-VIII, a compound represented by Formula A and a compound represented by Formula B:

M-VIII

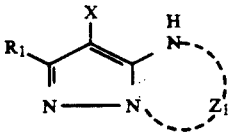

wherein $Z_1$ represents a group of non-metallic atoms necessary for forming a nitrogen-containing 5-member heterocyclic ring which may have a substituent; X represents a hydrogen atom or a group which can be released by a coupling reaction with the oxidized product of a color developing agent; and $R_1$ represents a hydrogen atom or an alkyl group having 1 to 4 carbon atoms,

A

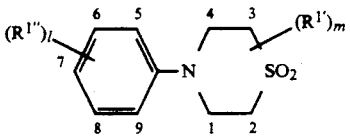

wherein $R^{1''}$ is an alkoxy, alkyl, alkylthio, amido, ureido, or halogen, $R^{1'}$ is an alkyl, m is an integer of 0 to 4, 1 is an integer of 1 or 2,

B

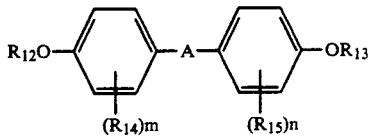

wherein $R_{12}$ and $R_{13}$ each represent a hydrogen atom or an alkyl; $R_{14}$ and $R_{15}$ each represent an alkyl, alkoxy, aryl, aryloxy or hydroxy group; m and n each represent an integer of 0 to 2,;; and A represents an alkylene group having 1 to 6 carbon atoms in its main chain.

* * * * *